US005331755A

United States Patent [19]

Kwok

[11] Patent Number: 5,331,755

[45] Date of Patent: Jul. 26, 1994

[54] IRONING PRESS WITH HORIZONTALLY ROTATABLE PRESSING MEMBERS

[75] Inventor: James K. H. Kwok, Quarry Bay, Hong Kong

[73] Assignee: The Singer Company NV, Curacao, Netherlands

[21] Appl. No.: 145,127

[22] Filed: Nov. 3, 1993

[51] Int. Cl.[5] ..... D06F 71/08

[52] U.S. Cl. ..... 38/18; 38/25

[58] Field of Search ..... 38/1 R, 1 A, 15–18, 38/20, 24, 25, 27, 30, 32, 42, 71; 100/210, 211, 214, 219, 232, 238, 257

[56] References Cited

U.S. PATENT DOCUMENTS

| | | | |
|---|---|---|---|
| 699,922 | 5/1902 | Hyson et al. | 38/104 |
| 1,122,590 | 12/1914 | Hale, Jr. | 38/16 |
| 1,729,353 | 9/1929 | Mitkoff | 38/103 |
| 2,011,388 | 8/1935 | Watts | 38/30 |
| 2,142,202 | 1/1939 | McKay | 38/26 |
| 4,480,556 | 11/1984 | Wilson et al. | 38/103 X |
| 4,543,739 | 10/1985 | Zerhoch et al. | 38/103 X |
| 4,689,905 | 9/1987 | Vartan | 38/26 |

*Primary Examiner*—Clifford D. Crowder
*Assistant Examiner*—Ismael Izaguirre

[57] ABSTRACT

A steam ironing press is provided with a frame having a stationary lower section and a horizontally elongated upper section vertically pivotable about the lower section. A lower horizontally elongated member is secured to the lower section and is manually rotatable thereabout in a horizontal plane between a position for use at which the lower member extends horizontally at right angles to the direction of elongation of the upper section and a position for shipping at which the lower member extends in the direction of elongation of the upper section. An upper horizontally elongated member is secured to the upper section and is manually rotatable thereabout in a horizontal plane between a position for use at which the upper member extends horizontally at right angles to the direction of elongation of the upper section and a position for shipping at which the lower member extends in the direction of elongation of the upper section. The upper and lower members are in vertical alignment when both members are in the same position. A first mechanism interconnects the upper member and the upper section and is manually operable to lock the upper member in either selected position or to unlock the upper member to permit manual rotation thereof. A second mechanism interconnect the lower member and the lower section and is manually operable to lock the lower member in either selected position or to unlock the lower member to permit manual rotation thereof.

6 Claims, 2 Drawing Sheets

IRONING PRESS WITH HORIZONTALLY ROTATABLE PRESSING MEMBERS

BACKGROUND OF THE INVENTION

Known portable steam ironing presses, as disclosed for example in U.S. Pat. No. 4,955,152, employ a frame having a stationary lower section and a horizontally elongated upper section vertically pivotable about the lower section. A lower horizontally elongated member is secured to the lower section. An upper horizontally elongated member is secured to the upper section. The upper section can be manually pivoted upward to a position at which the upper member is spaced above the lower member and can be manually pivoted downward to bring the upper member into engagement with the lower member. An article to be pressed is disposed between the members while they are separated and is squeezed therebetween when the members engage. The article is pressed using heat and steam supplied with appropriate timing via the upper member.

In such presses, the two members extend horizontally outward at right angles to the direction of elongation of the upper section. However, while this arrangement is required during normal use, it is awkward and expensive to ship these presses because of the outward extension of the members. It is also awkward and sometimes difficult to move these presses from place to place.

The present invention is directed toward steam ironing presses of this known type in which this shipping problem is overcome. To this end, these presses are constructed in such manner that the members can be manually rotated and locked into a position for shipping at which the members are parallel to and aligned with the direction of elongation of the upper section.

The presses can be shipped easily and less expensively when the members are rotated into this shipping position and, moreover, it is easier to move the presses from place to place when the members are in this position.

Once the presses are placed in a position for normal use, the members can be unlocked manually and then rotated and locked into a position for use at which the members extend horizontally at right angles to the frame. Once in the position for normal use, the presses can then be operated in conventional manner.

SUMMARY OF THE INVENTION

In accordance with the principles of this invention, a steam ironing press employs a frame having a stationary lower section and a horizontally elongated upper section vertically pivotable about the lower section.

A lower horizontally elongated member is secured to the lower section and is manually rotatable thereabout in a horizontal plane between a position for use at which the lower member extends horizontally at right angles to the direction of elongation of the upper section and a position for shipping at which the lower member extends in the direction of elongation of the upper section;

An upper horizontally elongated member is secured to the upper section and is manually rotatable thereabout in a horizontal plane between a position for use at which the upper member extends horizontally at right angles to the direction of elongation of the upper section and a position for shipping at which the lower member extends in the direction of elongation of the upper section, the upper and lower members being in vertical alignment when both members are in the same position.

A first mechanism interconnects the upper member and the upper section and is manually operable to lock the upper member in either selected position or to unlock the upper member to permit manual rotation thereof;

A second mechanism interconnects the lower member and the lower section and is manually operable to lock the lower member in either selected position or to unlock the lower member to permit manual rotation thereof.

The advantages of this invention either will be explained or will become apparent hereinafter.

DETAILED DESCRIPTION OF PREFERRED EMBODIMENT

Figure 1:
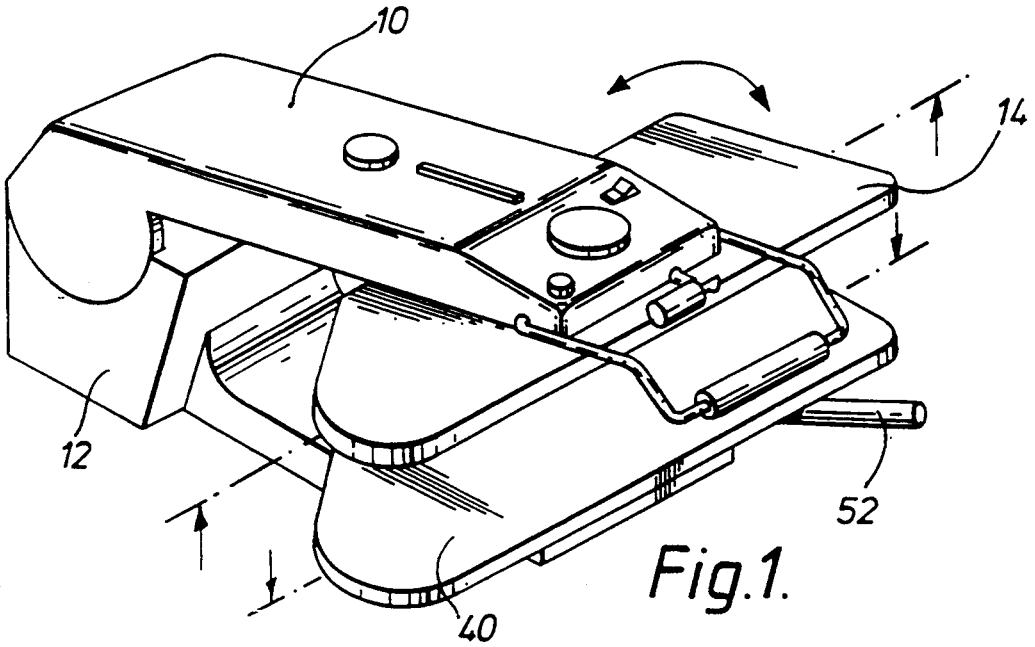
FIG. 1 is a perspective view of the invention in position for normal use.
Figure 2:
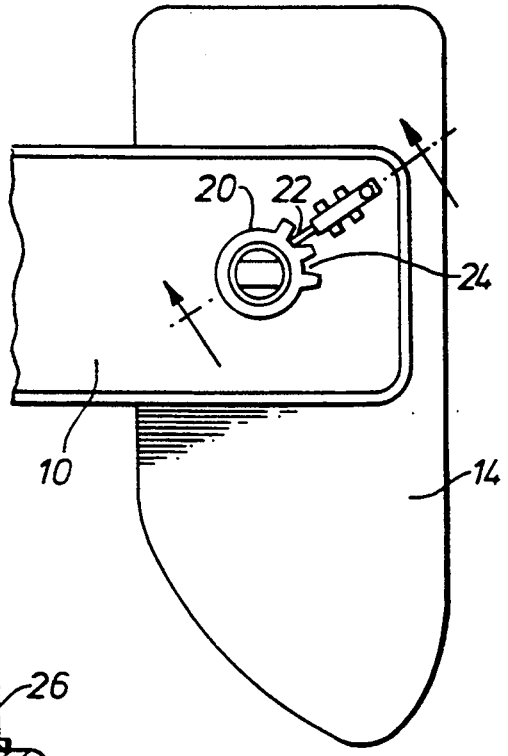
FIG. 2 is a view of an upper member as taken along line 2—2 in FIG. 1.
Figure 3:
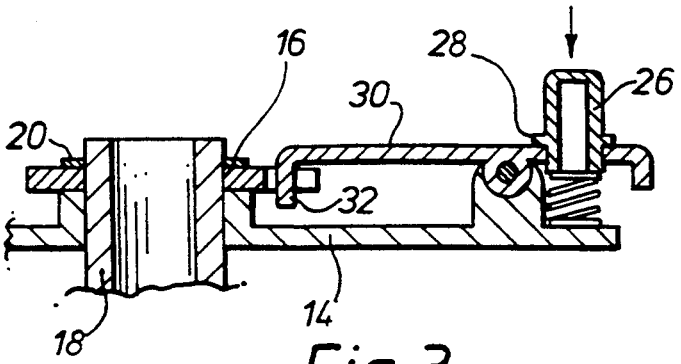
FIG. 3 is a detail view of a first mechanism which cooperates with the upper member.
Figure 4:
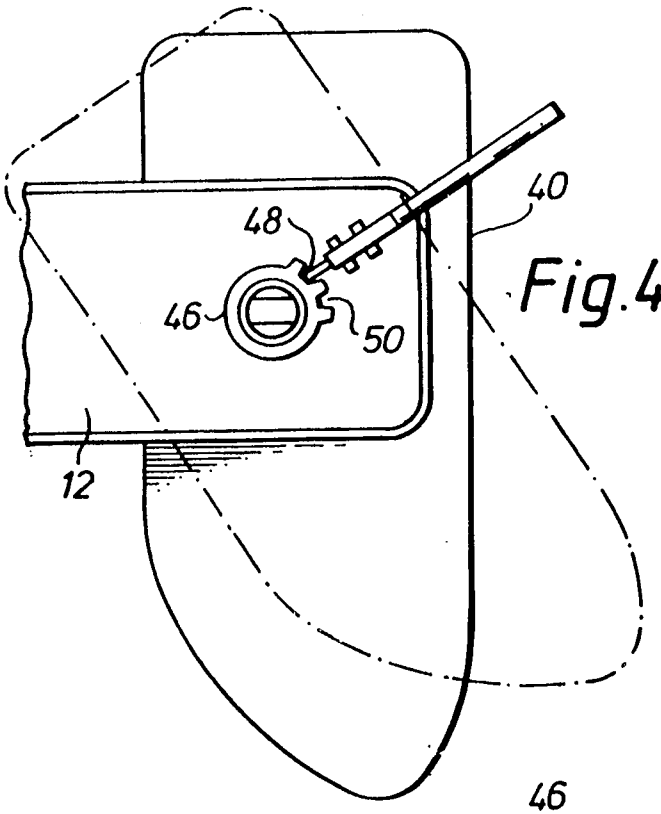
FIG. 4 is a view of a lower member taken along line 4—4 in FIG. 1.
Figure 5:
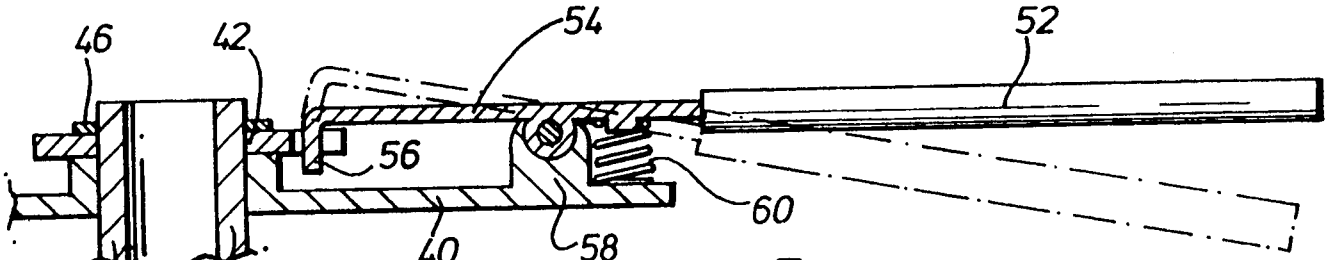
FIG. 5 is a detail view of a second mechanism which cooperates with the lower member shown in inverted position.

Referring now to FIGS. 1-5, the invention employs a frame having a horizontally elongated upper section 10 vertically pivotable about a stationary lower section 12.

An upper horizontally elongated member 14 has a circular opening 16 through which a fixed vertical shaft 18 extends. Member 14 has a circular lip 20 extending upward from the plane of the member 14 and surrounding the shaft. Lip 20 contains first and second spaced slots 22 and 24. Member 14 is manually rotatable about a selected arc, one end of which is defined by slot 22, the other end being defined by slot 24.

A spring loaded button 26 extends through a top surface of the upper section and is normally spring biased to a fully raised position. Button 26 has a horizontal lip 28 which engages one pivotable end of lever 30. The other downwardly projecting end 32 of lever 30, when the button is fully raised engages either one of the two slots depending upon the position of manual rotation of member.

When slot 22 is engaged, the member 14 is locked into the use position disposed at right angles to the direction of elongation of the upper section. When slot 24 is engaged, the member is locked into the shipping position disposed coincident with the direction of elongation of the upper section.

When the button is depressed, the lever 30 is pivoted by downward movement of lip 28 until end 32 is raised above both slots and the member 14 can be rotated as desired for movement into either use or shipping position.

A lower horizontally elongated member 40 has a circular opening 42 through which a fixed vertical shaft 44 extends. Member 40 has a circular lip 46 extending downward from the plane of the member 14 and surrounding the shaft. Lip 46 contains first and second spaced slots 48 and 50 Member 40 is manually rotatable about a selected arc, one end of which is defined by slot 48, the other end being defined by slot 50.

An elongated handle 52 projects outwardly below member 40. The inner end of handle 52 connects to one end of lever 54. The opposite end 56 of lever 54 projects upwardly. Lever 54 between its ends is pivotable in downwardly extending support 58. Handle 52 is normally spring biased into horizontal position by spring 60 extending between the handle and the member 40.

When the handle is in horizontal position, end 56 engages either one of the two 48 and 50, depending upon the position of manual rotation of member.

When slot 48 is engaged, the member 40 is locked into the use position disposed at right angles to the direction of elongation of the upper section. When slot 50 is engaged, the member 40 is locked into the shipping position disposed coincident with the direction of elongation of the upper section.

When the handle is inclined downwardly, the lever 54 is pivoted until end 56 is lowered below both slots and the member 40 can be rotated as desired for movement into either use or shipping position.

While the invention has been described with particular reference to the preferred embodiment and the drawings, the protection sought is to be limited only by the terms of the claims which follow.

What is claimed is:

1. A steam ironing press comprising:

a frame having a stationary lower section and a horizontally elongated upper section vertically pivotable about the lower section;

a lower horizontally elongated member secured to the lower section and manually rotatable thereabout in a horizontal plane between a position for use at which the lower member extends horizontally at right angles to the direction of elongation of the upper section and a position for shipping at which the lower member extends in the direction of elongation of the upper section;

an upper horizontally elongated member secured to the upper section and manually rotatable thereabout in a horizontal plane between a position for use at which the upper member extends horizontally at right angles to the direction of elongation of the upper section and a position for shipping at which the lower member extends in the direction of elongation of the upper section, the upper and lower members being in vertical alignment when both members are in the same position;

a first mechanism interconnecting the upper member and the upper section and manually operable to lock the upper member in either selected position or to unlock the upper member to permit manual rotation thereof; and a second mechanism interconnecting the lower member and the lower section and manually operable to lock the lower member in either selected position or to unlock the lower member to permit manual rotation thereof.

2. The press of claim 1 wherein each mechanism has a lever which has a first unlocking position and a second and different locking position.

3. The press of claim 2 wherein each member has first and second spaced slots, the corresponding member being locked in use position when the lever of the corresponding mechanism is placed in the second position and engages the first slot.

4. The press of claim 3 wherein the corresponding member is locked into shipping position when the lever of the corresponding mechanism is placed in the second position and engages the second slot.

5. The press of claim 4 wherein the lever of the corresponding mechanism is normally in the second position and is only placed in the first position when manually pressure is applied to to the corresponding mechanism.

6. The press of claim 5 wherein the corresponding mechanism is spring loaded to maintain the corresponding lever in the second position.

* * * * *